US009229464B2

(12) United States Patent
Buescher et al.

(10) Patent No.: US 9,229,464 B2
(45) Date of Patent: Jan. 5, 2016

(54) LOW DROP-OUT VOLTAGE REGULATOR

(71) Applicant: EM Microelectronic-Marin S.A., Marin (CH)

(72) Inventors: Kevin Buescher, Colorado Springs, CO (US); Jiri Buryanec, Prague (CZ)

(73) Assignee: EM Microelectronic-Marin S.A., Marin (CH)

( * ) Notice: Subject to any disclaimer, the term of this patent is extended or adjusted under 35 U.S.C. 154(b) by 161 days.

(21) Appl. No.: 13/955,380

(22) Filed: Jul. 31, 2013

(65) Prior Publication Data

US 2015/0035506 A1 Feb. 5, 2015

(51) Int. Cl.

| | |
|---|---|
| ***G05F 1/00*** | (2006.01) |
| ***G05F 1/595*** | (2006.01) |
| ***G05F 1/56*** | (2006.01) |

(52) U.S. Cl.

CPC . *G05F 1/595* (2013.01); *G05F 1/56* (2013.01)

(58) Field of Classification Search

CPC ..... G05F 1/56; G05F 1/575

USPC ..... 323/273–281, 311–316; 327/537–543

See application file for complete search history.

(56) References Cited

U.S. PATENT DOCUMENTS

| | | | | |
|---|---|---|---|---|
| 8,115,463 | B2 * | 2/2012 | Wang | 323/280 |
| 2006/0261797 | A1 | 11/2006 | Man et al. | |
| 2008/0157735 | A1 | 7/2008 | Liu et al. | |
| 2011/0101936 | A1 * | 5/2011 | Wang | 323/280 |

FOREIGN PATENT DOCUMENTS

EP 1 806 640 A2 7/2007

OTHER PUBLICATIONS

Hua Chen et al., "A Fast-Transient LDO Based on Buffered Flipped Voltage Follower", 2010 IEEE International Conference of Electron Devices and Solid-State Circuits (EDSSC), XP-31979101A, 2010, 4 pages.

Ka ChuTi Kwok et al., "Pole-zero Tracking Frequency Compensation for Low Dropout Regulator", 2002 IEEE, XP-55166785A, 2002, 4 pages.

* cited by examiner

*Primary Examiner* — Timothy J Dole
*Assistant Examiner* — Htet Z Kyaw
(74) *Attorney, Agent, or Firm* — Oblon, McClelland, Maier & Neustadt, L.L.P.

(57) ABSTRACT

The voltage regulator comprises a regulation loop (2), which comprises at least a pass transistor (18), a source transistor (28), a sensing transistor (22) and a retention transistor (24), and a stability compensation circuit (10), which comprises a first MOS resistor (12) and a second MOS resistor (14) coupled with the first MOS resistor (12). The gate of the second MOS resistor (14) is coupled to the gate of the pass transistor (18).

9 Claims, 4 Drawing Sheets

LOW DROP-OUT VOLTAGE REGULATOR

FIELD OF THE INVENTION

The present invention relates to the field of voltage regulators and in particular to low dropout (LDO) regulators.

BACKGROUND AND PRIOR ART

A low dropout or LDO regulator is a DC linear voltage regulator which can operate with a comparatively small input-output differential voltage. In general, such regulators feature a comparatively low dropout voltage and a comparatively low minimum operating voltage, further having a high efficiency operation and comparatively low heat dissipation. Typically, such regulators comprise at least one field effect transistor (FET) which is typically implemented by a metal oxide semiconductor component.

Low dropout regulators are of particular interest when it comes to efficient power management in battery operated portable consumer products. The fundamental design challenge in an LDO is to stabilize it over a zero load current (no load) to a maximum load current (full load) that is required for a particular application. Moreover, LDO regulators should exhibit a stable and fast transient response to load modifications. More specifically, a transient voltage peak in a controlled output of the LDO should not exceed a maximum voltage range both during dynamic load current steps and large current spikes inherent to digital load circuitry.

Typically, LDO regulators also comprise at least one capacitor, e.g. for a dominant pole frequency compensation at the output of the regulator. A non-ideal behavior of such a capacitor can be modeled with an equivalent resistance which typically generates a zero in the loop transfer function of the LDO regulator. Crucial drawbacks of prior art solutions arise from the fact that the LDO stability critically depends on the value of the equivalent resistance, which does not only depend on the manufacturer of the capacitor but also varies with an operating frequency and temperature. The equivalent resistance of such LDO regulators therefore imposes a stability problem.

SUMMARY OF THE INVENTION

It is therefore an objective of the present invention to provide an improved voltage regulator, in particular an LDO regulator which is operable to compensate a zero frequency with respect to a variable load at the output of the regulator. Moreover, the voltage regulator should provide a stable output for a variable load as well as for varying external conditions such as varying temperatures. Additionally, the regulator should exhibit a stable transient behavior in response to load modifications.

In a first aspect the invention relates to a voltage regulator, typically to a low dropout regulator. The voltage regulator comprises a regulation loop comprising at least a pass transistor, a source transistor, a sensing transistor and a retention transistor. These transistors are typically implemented as MOS transistors of either PMOS or NMOS-type. The mentioned transistors may be alternatively denoted as first, second, third and fourth transistors establishing the regulation loop. However, for reasons of a functional description, the four transistors are denoted according to their generic function and behavior in the regulation loop.

The pass transistor is actually coupled to the output of the voltage regulator and is therefore adapted to provide a regulated output voltage. The source transistor is typically part of a current mirror and is adapted to couple a driving current to the regulation loop. The sensing transistor is typically coupled to a reference voltage and serves to define the output voltage of the regulator. The retention transistor is actually operable to keep and to maintain a particular voltage in and/or across the regulation loop.

The regulation loop is particularly adapted to provide a rather constant regulated output voltage Vreg at an output, hence at the drain of the pass transistor. In a steady state, hence after a transient switching on or switching off or after transient load variations the regulation loop is adapted to autonomously stabilize and to provide the predefined output voltage at the output.

Additionally and in order to compensate a negative impact of varying load, varying temperature or other varying external conditions, the voltage regulator comprises a stability compensation circuit. Said stability compensation circuit comprises a first MOS resistor and a second MOS resistor coupled with the first MOS resistor. Here, the first MOS resistor is a rather stable MOS resistor and exhibits no variations of its resistivity or of its equivalent resistivity even at varying load conditions.

The second MOS resistor is however coupled to the gate of the pass transistor. In particular, the gate of the second MOS resistor is coupled to the gate of the pass transistor. In this way, the second MOS resistor is a variable resistor that changes its resistivity or equivalent resistivity depending on varying load conditions of the regulation loop or of the voltage regulator. In this way, the voltage applied to the gate of the pass transistor may be adapted to varying loads of the regulation loop. In this way, a variable zero can be inserted in the loop transfer function to enhance the actual operating conditions of the voltage regulator.

According to a further embodiment the stability compensation circuit comprises a first node or an input node coupled with the source transistor's source and being further coupled with the pass transistor's source. Hence, an input of the stability compensation circuit is parallel to the sources of the source transistor and the pass transistor.

The first node may also be denoted as a control node which is also coupled with the source transistor's gate and with the pass transistor's gate. In this way the resistance of the MOS resistors can be controlled and/or modified.

Since the input or control node of the compensation network is connected to the pass transistor's source and hence to the input voltage $V_{DD}$, the compensation network is effectively placed between the gate and source of said pass transistor. This will allow improved PSR (power supply rejection) due to the effective capacitance transferring noise from the source to the gate of the pass transistor thus keeping the voltage between the source and gate more constant which then rejects some of the noise. This is a particular benefit over embodiments wherein the compensation network is connecting between the drain and gate of the pass transistor.

According to another embodiment the compensation circuit comprises a second node coupled with the drain of the retention transistor and being further coupled with the drain of the source transistor. Hence, the second or output node of the compensation circuit is coupled parallel to the drains of the retention transistor and the source transistor.

Moreover, and according to another embodiment the compensation circuit comprises at least one capacitor coupled with a drain of at least one of the first MOS resistor and of the second MOS resistor. By means of the capacitor the compensation circuit and hence the regulation loop exhibits a particular equivalent resistance that changes with the load current on the output of the voltage regulator. This allows that the total resistance of the stability compensation circuit varies with the load of the voltage regulator.

Consequently, this varying resistance serves to move the zero frequency or the zero location towards a frequency band which substantially enhances the actual operating condition of the voltage regulator. In this way, the stability of the voltage regulator in response to varying external conditions such as temperature but as well as to varying load conditions can be improved.

According to another embodiment the second node of the stability compensation circuit is coupled to the gate of the second MOS resistor as well as to the gate of the pass transistor.

Additionally or optionally the second node may be also connected to the capacitor. Typically, the second node is connected to a first terminal of the capacitor while an opposite, hence a second terminal of the capacitor is connected with the drain of at least one of the first or second MOS resistors. Typically, the drain of at least one of the first and second MOS resistors, the capacitor and the second node are arranged in series. Hence, the drain of at least one of the first and second MOS resistors is connected to the second node via the at least one capacitor.

The capacitor serves to modify the transient behavior of both, the compensation circuit as well as of the regulation loop. The capacitor is effectively located between an input port of the voltage regulator and the gate of the pass transistor. By way of the capacitor the ramp up or ramp down velocity of the regulation behavior of the voltage regulator can be modified and adapted to predefined conditions. Hence, the capacitor serves to control or to modify the dynamic behavior of at least the pass transistor.

According to another embodiment the first MOS resistor and the second MOS resistor are arranged in parallel with their sources connected to the first node of the stability compensation circuit. Moreover and according to a further embodiment the first MOS resistor and the second MOS resistor are also arranged in parallel with their drains connected to the second node. Hence, the source of the first MOS resistor is connected to the source of the second MOS resistor. Additionally, also the drain of the first MOS resistor may be connected to the drain of the second MOS resistor.

Mutually connected sources of first and second MOS resistors may be connected to the first node whereas connected drains of the first node or control node and the second MOS resistors may be connected to the second node. The drain of the first MOS resistor may be connected to an input port via a further transistor, e.g. via a transistor of an input current mirror. In this way, the first MOS resistor is driven by a constant voltage and therefore exhibits a rather constant resistance.

In a further embodiment the stability compensation circuit comprises a third resistor between the drains of the first and the second MOS resistors and the second node. The third resistor may either be implemented as a conventional resistor or as well as a MOS resistor. Implementation of a MOS resistor as the third resistor provides a tunability of the resistance of the third resistor if required. In this way, the behavior of the stability compensation circuit may be arbitrarily modified.

Typically, the third resistor is connected to both drains of first and second resistors. Hence, the third resistor is in parallel to first and second MOS resistors while an opposite terminal of the third resistor is connected to the second node or is further in line or in series with the capacitor connected to the second node.

According to another and alternative embodiment the first and second MOS resistors are arranged in series, wherein the first MOS resistor's drain is connected to the second MOS resistor's source.

Following another embodiment the first MOS resistor's source is connected to the first node whereas the second MOS resistor's drain is connected to the second node.

Any one of the above described varying topologies and architectures of the arrangement and connection of first and second MOS resistors, in combination with a third resistor and/or in combination with at least one capacitor provides different modifications of the zero frequency of the equivalent resistance of the stability compensation circuit and hence of the entire regulation loop. With varying arrangements of first and second MOS resistors the loop transfer function of the voltage regulator may be varied in different ways as to compensate any influence of varying load conditions. These variations on the MOS resistor connections and additionally with their relative sizes allows changing the ratio of the fixed resistance of the first MOS resistor and the variable resistance of the second MOS resistor and thus changing how the zero location moves with the load current of the regulator.

According to another embodiment, the pass transistor, the source transistor and the sensing transistor are designed as PMOS transistors. In alternative embodiments it is also conceivable, that said transistors comprise NMOS transistors.

Moreover and according to another embodiment, the retention transistor comprises or is an NMOS transistor. Typically, the retention transistor acts as a cascode transistor and serves to stabilize and to keep a predefined voltage of the regulation loop.

In another aspect the invention also relates to an electronic device comprising at least one voltage regulator as described above. Typically, the electronic device is a battery-driven electronic device, in particular a consumer electronic device, such like a camera, a mobile phone, a display application, a computing device or a computer periphery device.

It will be contemplated to those having ordinary skills in the art, that various modifications of the voltage regulator and of the electronic device may be made without departing from the general concept and scope of the present invention as it is defined in the appended claims.

BRIEF DESCRIPTION OF THE DRAWINGS

In the following, various embodiments of the invention will be described by making reference to the drawings, in which.

DETAILED DESCRIPTION

Figure 1:
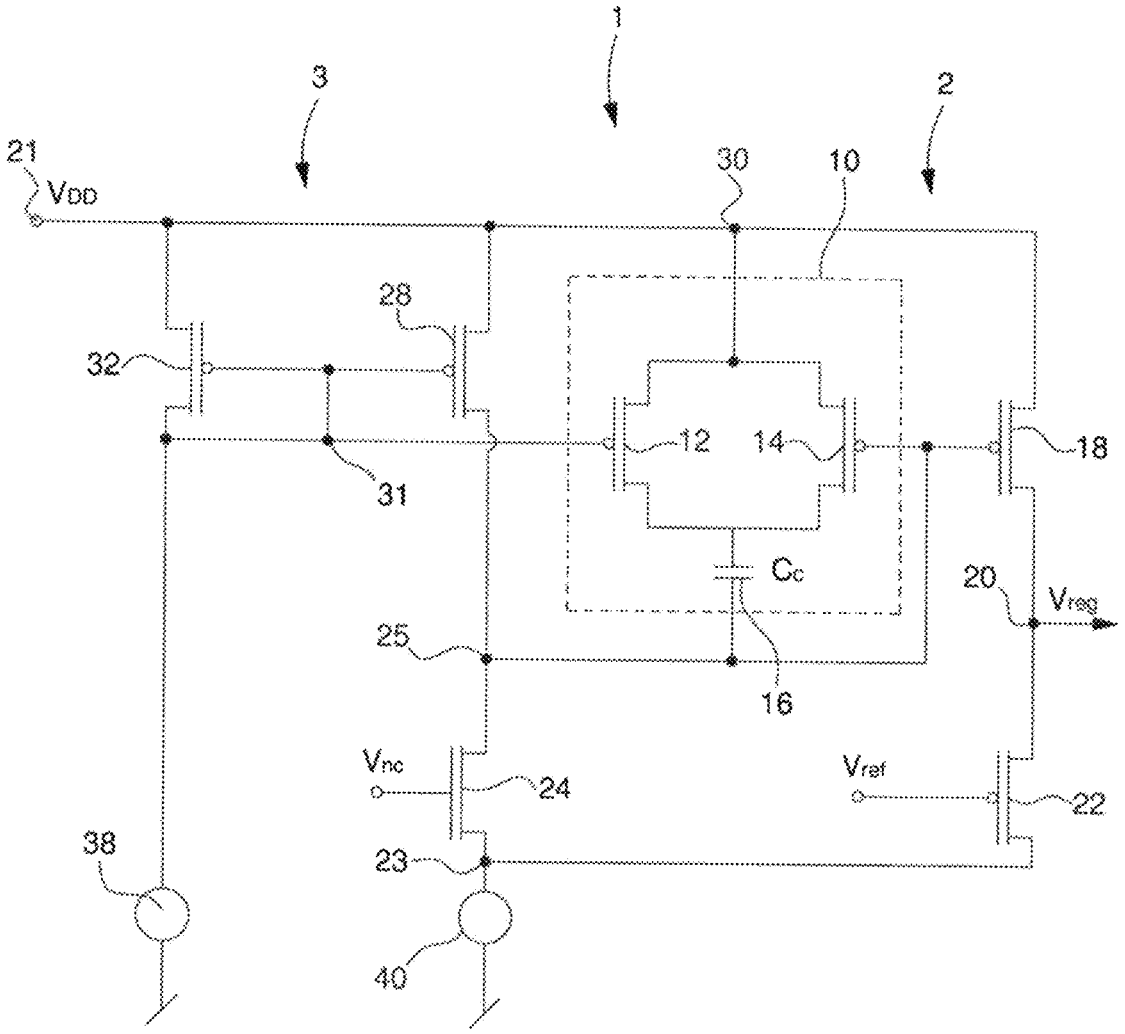
FIG. 1 schematically illustrates a circuit diagram of the voltage regulator according to a first embodiment.

The voltage regulator 1 as it is schematically illustrated in FIG. 1 comprises a regulation loop 2 featuring a pass transistor 18, a sensing transistor 22, a retention transistor 24 as well as a source transistor 28. The source transistor 28 together with a further transistor 32 sets up a current mirror 3. Hence, the source of the source transistor 28 and the source of the transistor 32 are connected to an input port 21, where an input voltage $V_{DD}$ is supplied. The transistor's 32 and the source transistor's 28 gates are mutually connected. A node 31 between the gates of the source transistor 28 and transistor 32 is connected with a drain of transistor 32. This particular node 31 is further connected with the gate of a first MOS resistor 12 as will be further explained below. The drain of the transistor 32 is connected with a first current source 38 connected to ground.

Moreover, the drain of the source transistor 28 is connected with a node 25, which is in series with the retention transistor 24. The retention transistor 24, typically acting as a cascode features a drain connected with the node 25 and hence with the drain of the source transistor 28. The source of the retention transistor 24 is connected with a node 23. Said node 23 is connected with a second current source 40, which in turn is coupled to ground.

The node 23 is furthermore connected to the drain of the sensing transistor 22. The source of said sensing transistor 22 is connected to an output node 20 of the voltage regulator 1, where a regulated output voltage Vreg will be provided. The gate of the sensing transistor 22 is connected to a reference voltage Vref. The output node 20 is furthermore connected with a drain of the pass transistor 18. The source of the pass transistor 18 is connected to a first node 30 of a stability compensation circuit 10. Said first node 30 is furthermore connected to the source of the source transistor 28. Hence, the first node 30 effectively acts as a control node 30, which is also connected to the input port 21.

The stability compensation circuit 10 comprises a first MOS resistor 12, typically in form of a MOSFET. The stability compensation circuit furthermore comprises a second MOS resistor 14, which is also typically implemented as a MOSFET. As illustrated in FIG. 1, the sources of the first and the second MOS resistors 12, 14 are interconnected and are further coupled to the first node 30 of the stability compensation circuit 10. In the embodiment according to FIG. 1, the respective drains of the first and the second MOS resistors 12, 14 are mutually connected. Said drains are furthermore connected to a capacitor 16 featuring a capacity Cc.

One terminal of the capacitor 16 is connected to both drains of the first and second MOS resistors 12, 14. An opposite terminal of the capacitor 16 is however connected to a second node 25. The second node 25 is also the direct connection between the gate of the second MOS resistor 14 and the gate of the pass transistor 18 as illustrated in FIG. 1.

The two MOS resistors 12, 14 are in series with the capacitor 16 to provide a sufficient phase margin to maintain stability of the regulation loop. The equivalent resistance of MOS resistors 12 and 14 is proportional to the inverse of a difference between a voltage Vgs and a threshold voltage Vth, wherein Vgs represents the difference between the gate voltage of first and second MOS resistors 12, 14 and the input voltage $V_{DD}$ and wherein Vth is the device threshold voltage or turn on voltage. Therefore, the first MOS resistor 12 provides a fixed resistance, whereas the resistance of the second MOS resistor 14 varies with Vgs, since the voltage Vgs changes with the load current on the output node 20.

Upon startup and when assuming, that a current pulling down on the retention transistor 24 is larger than the current pulling up through the source transistor 28, the voltage of the second node 25 connected to the gate of the pass transistor 18 is assumed to be zero. Since the pass transistor 18 is typically implemented as a PMOS device, a zero voltage at its gate will turn the pass transistor 18 on and will start to pull up the output voltage Vreg at the output node 20. The regulated output voltage Vreg will continue to rise until an equilibrium is reached. The steady state condition or equilibrium will be reached when the current through the retention transistor 24 equals the current through the source transistor 28. The equilibrium will be reached because a current from the sensing transistor 22 siphons off current from the second current source 40. As a consequence there will be less current through the retention transistor 24.

This regulation will continue until the current through the retention transistor 24 equals the current through the source transistor 28. Then, the regulation loop 2 will be in a steady state condition, wherein the output voltage Vreg is approximately the sum of the reference voltage Vref and the threshold voltage of the sensing transistor 22.

Figure 2:
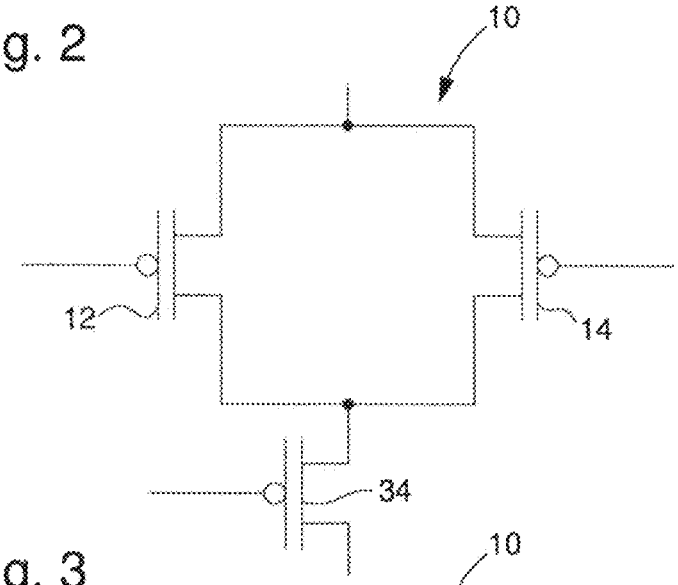
FIG. 2 shows a second embodiment of the MOS resistor arrangement of the stability compensation circuit.
Figure 3:
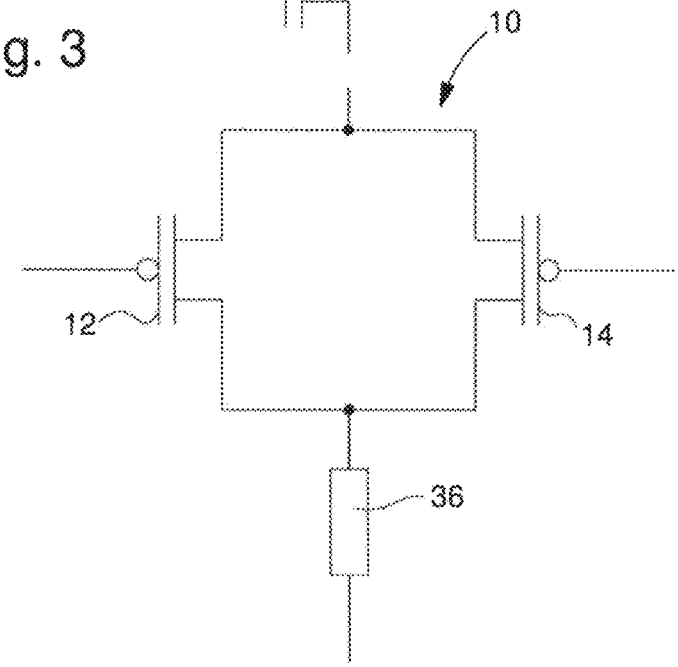
FIG. 3 shows a third embodiment of the MOS resistor arrangement of the stability compensation circuit.
Figure 4:
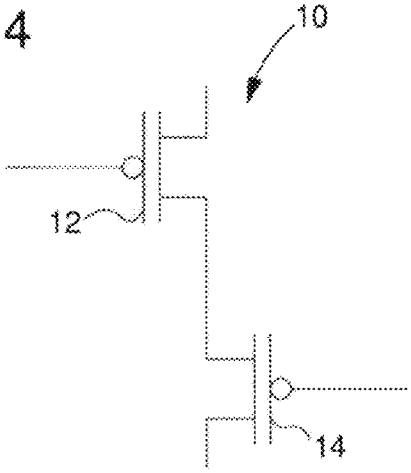
FIG. 4 shows a fourth embodiment of the MOS resistor arrangement of the stability compensation circuit.

The various alternative embodiments as illustrated in FIGS. 2, 3 and 4 show different configurations of a mutual coupling of first and second MOS resistors 12, 14. In this way, various different specific load-dependent movements of the equivalent resistance of the MOS resistor arrangement, typically in combination with the capacitor 16 can be attained, in order to move the zero frequency of the loop transfer function of the voltage regulator 1.

As illustrated in FIG. 2, a third resistor 34, in form of another MOS resistor is connected by its source to the drains of first and second MOS resistors 12, 14. In the embodiment according to FIG. 3, the MOS resistor 34 is exchanged by a conventional resistor 36. Here, the resistor 36 is connected to the drains of the first and of the second MOS resistors 12, 14, which are also interconnected. An opposite terminal of the resistor 36 is thus connected to the capacitor 16.

Moreover, in the embodiment according to FIG. 4, the two MOS resistors 12, 14 are arranged in series. Here, the drain of the first MOS resistor 12 is connected to the source of the second MOS resistor 14. The source of the first MOS resistor 12 will then be connected to the first node 30, whereas the drain of the second MOS resistor 14 will be connected to the capacitor 16 and/or to the second node 25.

Figure 5:
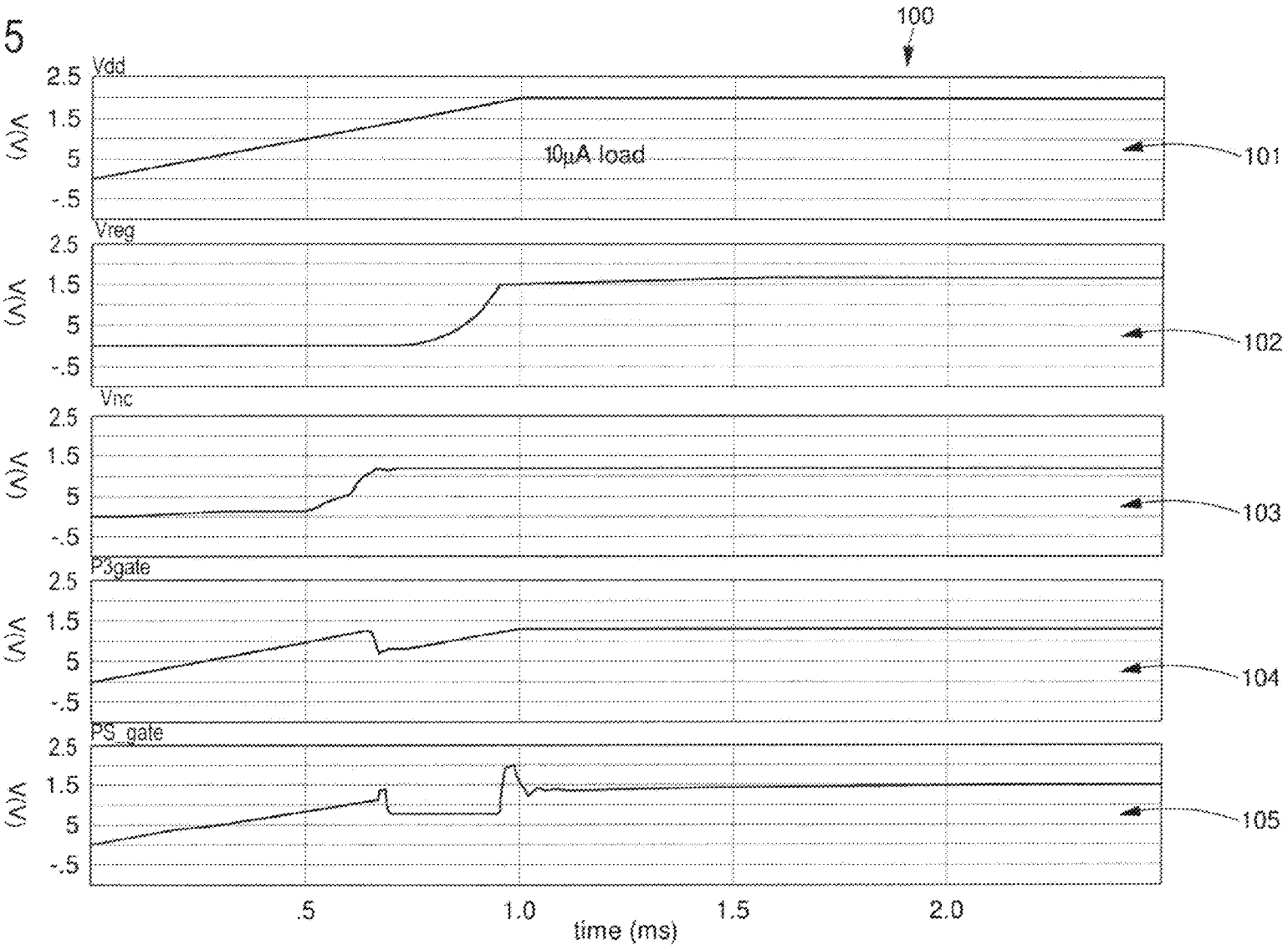
FIG. 5 shows the transient behavior of the voltage regulator at a comparatively low load.

In the diagram according to FIG. 5, a transient behavior upon switching on of the voltage regulator 1 is illustrated for a comparatively low load of about 10 μA. Here, the transient behavior is illustrated over time in milliseconds. In the diagram 100 the input voltage $V_{DD}$ is shown in the graph 101, a respective output voltage Vreg is shown in the graph 102. The graph 103 represents the voltage Vnc, which is present at the gate of the retention transistor 24. The gate voltage of the first MOS resistor 12 is represented in graph 104, whereas the gate voltage of the pass transistor 18 is shown in graph 105 over time. As can be seen in the graph 102, the regulated output voltage almost abruptly rises from a zero voltage level to a rather stable output voltage level of 1.5 V, within a time interval of approximately 1 ms.

Figure 6:
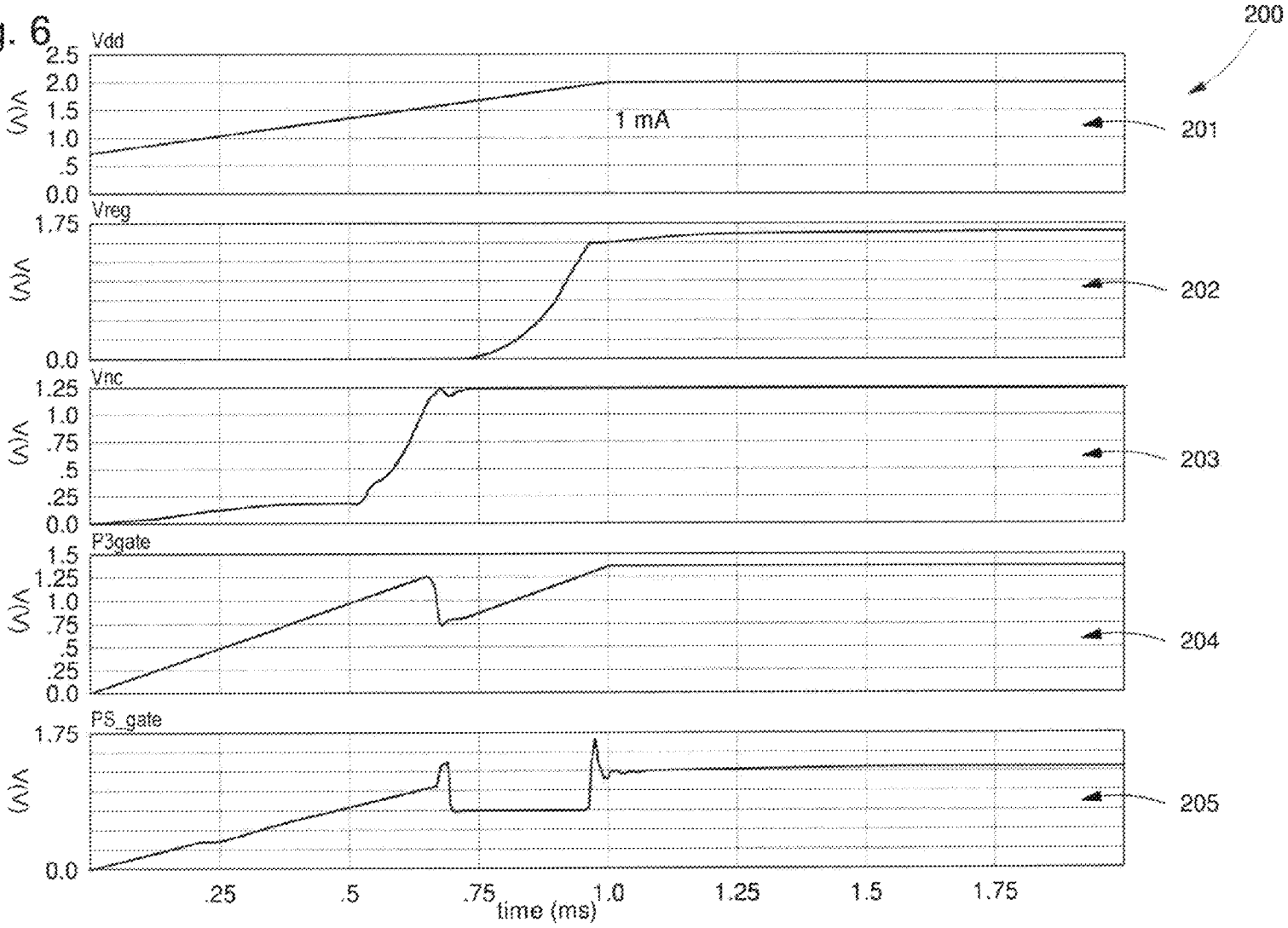
FIG. 6 shows the transient behavior of the voltage regulator at a comparatively large load.

A comparison with the respective graphs 201, 202, 203, 204, 205 of the diagram 200 according to FIG. 6 also shows a rather constant regulated output voltage Vreg of approximately 1.5 V after about 1 ms. The various graphs 201, 202, 203, 204, 205 directly correspond to respective graphs 101, 102, 103, 104, 105 as already described in connection with the diagram 100 of FIG. 5. In contrast to the situation of FIG. 5, the diagram according to FIG. 6 represents a load of 1 mA, which is a factor 100 larger compared to the load of the diagram according to FIG. 5.

The comparison of the diagrams 100, 200 of FIGS. 5 and 6 reveals, that the voltage regulator 1 exhibits a rather stable and constant output voltage Vreg even at different load conditions.

What is claimed is:

1. A voltage regulator comprising:

a regulation loop comprising at least a pass transistor, a source transistor, a sensing transistor and a retention transistor, and a stability compensation circuit comprising a first MOS resistor and a second MOS resistor, coupled with the first MOS resistor, wherein a gate of the second MOS resistor is coupled to a gate of the pass transistor, wherein the stability compensation circuit comprises a second node coupled with a drain of the retention transistor and with a drain of the source transistor, and wherein the first MOS resistor and the second MOS resistor are arranged in parallel with drains of the first and second MOS resistors connected to the second node.

2. The voltage regulator according to claim 1, wherein the stability compensation circuit comprises a first node coupled with a source of the source transistor and with a source of the pass transistor.

3. The voltage regulator according to claim 1, wherein the stability compensation circuit comprises at least one capacitor coupled by a first terminal with a drain of at least one of the first MOS resistor and the second MOS resistor, and wherein a second terminal of the capacitor is connected to the second node coupled with the drain of the retention transistor and with the drain of the source transistor.

4. The voltage regulator according to claim 1, wherein the second node is coupled to the gate of the second MOS resistor and to the gate of the pass transistor.

5. The voltage regulator according to claim 2, wherein the first MOS resistor and the second MOS resistor are arranged in parallel with sources of the first and second MOS resistors connected to the first node.

6. The voltage regulator according to claim 1, wherein the stability compensation circuit comprises a third resistor between the drains of the first and second MOS resistors and the second node.

7. The voltage regulator according to claim 1, wherein the pass transistor, the source transistor and the sensing transistor are PMOS transistors.

8. The voltage regulator according to claim 1, wherein the retention transistor is an NMOS transistor.

9. An electronic device comprising at least one voltage regulator according to claim 1.

* * * * *